United States Patent [19]

Piper et al.

[11] Patent Number: 4,791,432

[45] Date of Patent: Dec. 13, 1988

[54] ANTENNA AND METHOD FOR FABRICATING SAME

[76] Inventors: Robert J. Piper, 22494 Ray, Detroit, Mich. 48223; Helmut F. Homann, 16354 Greenland, Mt. Clemens, Mich. 48045

[21] Appl. No.: 945,802

[22] Filed: Dec. 24, 1986

Related U.S. Application Data

[62] Division of Ser. No. 756,055, Jul. 17, 1985, Pat. No. 4,673,950.

[51] Int. Cl.[4] ..... H01Q 15/14

[52] U.S. Cl. ..... 343/916; 343/912; 52/800

[58] Field of Search ..... 52/800, 802; 343/912, 343/916, 909

[56] References Cited

U.S. PATENT DOCUMENTS

| | | | |
|---|---|---|---|
| 2,644,777 | 7/1953 | Havens | 52/800 |
| 3,235,872 | 2/1966 | Schepis | 343/912 |
| 3,694,059 | 9/1972 | Shakespeare | 343/912 |
| 3,905,171 | 9/1975 | Cargill et al. | 52/800 |
| 4,378,560 | 3/1983 | Khorsand | 343/912 |
| 4,673,950 | 6/1987 | Piper et al. | 343/912 |

FOREIGN PATENT DOCUMENTS

| | | | |
|---|---|---|---|
| 0708717 | 5/1965 | Canada | 52/800 |

*Primary Examiner*—William L. Sikes
*Assistant Examiner*—Doris J. Johnson
*Attorney, Agent, or Firm*—Reising, Ethington, Barnard, Perry & Milton

[57] ABSTRACT

An antenna (10) and method for fabricating the antenna (10) includes an inner panel (12) with a curved inner receiving surface (14) and an outer panel (16) in coextensive relationship to one another. A plurality of strips (20) having undulations (22) are positioned between the inner (12) and outer (16) panels for interlocking the panels (12, 16) together in predetermined positions to define a composite antenna (10) of substantial strength to present the inner surface predetermined close tolerances over the surface thereof. The undulations (22) of the strip (20) include platform portions (24) for engaging the panels (12, 16) and straight angulated portions (26) interconnecting the platform portions (24). The strip (20) includes raised ribs (30) in the straight portions (26) and hinge portions (28) between the straight portions (26) and platform portions (24) to allow the lateral extent of the strip (20) to increase as the thickness of the strip (20) between the panels (12, 16) is decreased during fabrication.

9 Claims, 4 Drawing Sheets

ANTENNA AND METHOD FOR FABRICATING SAME

This is a division of application Ser. No. 756,055, filed on July 17, 1985, now U.S. Pat. No. 4,673,950.

TECHNICAL FIELD

The subject invention relates to radio antennas and, particularly, radio antennas utilized with transmitting satellites.

BACKGROUND ART

Radio antennas are extensively utilized with satellites to receive radio signals transmitted from these satellites. This is accomplished by an antenna having a concavely curved surface supported on a structural framework for receiving the signal and concentrating the signal upon a receiver centrally located above the curved surface.

The problem with such antennae is one of maintaining sufficiently close tolerances over the concave receiving surface. Very close tolerances in the concave surface may be maintained by close tolerances in the structural framework or in the surface after assembly by time-consuming and expensive machining processes.

STATEMENT OF INVENTION AND ADVANTAGES

A radio signal antenna and method for fabricating the antenna including an inner panel having a curved inner receiving surface and an outer panel is disclosed. A structural means positions the inner and outer panels in coextensive relationship to one another. The structural means is positioned between the inner and outer panels for interlocking the panels together over the extent thereof by moving the inner and outer panels toether to diminish the thickness of the structural means between the panels until the panels are in predetermined positions relative to one another and respectively engaging the structural means, and precisely positioning the inner surface of the inner panel within closely predetermined tolerances. The structural means is used to lock the structural means and the panels together in the predetermined position while maintaining the predetermined precise positions of the inner surface of the inner panel to define a composite antenna of substantial strength provided by the panels and structural means locked together to present the inner surface within the predetermined close tolerance over the surface thereof.

A preferred structural means comprises at least one strip having undulations connected to the respective panels to lock the panels together in the predetermined positions.

Accordingly, the subject invention maintains sufficiently close tolerances over the concave receiving surface by adjusting the structural frame during assembly, and locking the structural frame and panels together in the predetermined precise position. This allows for maintaining predetermined close tolerances over the concave surface during and after assembly. Also, the subject invention provides a quick efficient and inexpensive assembly process that doesn't require precise and expensive machining.

FIGURES IN THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
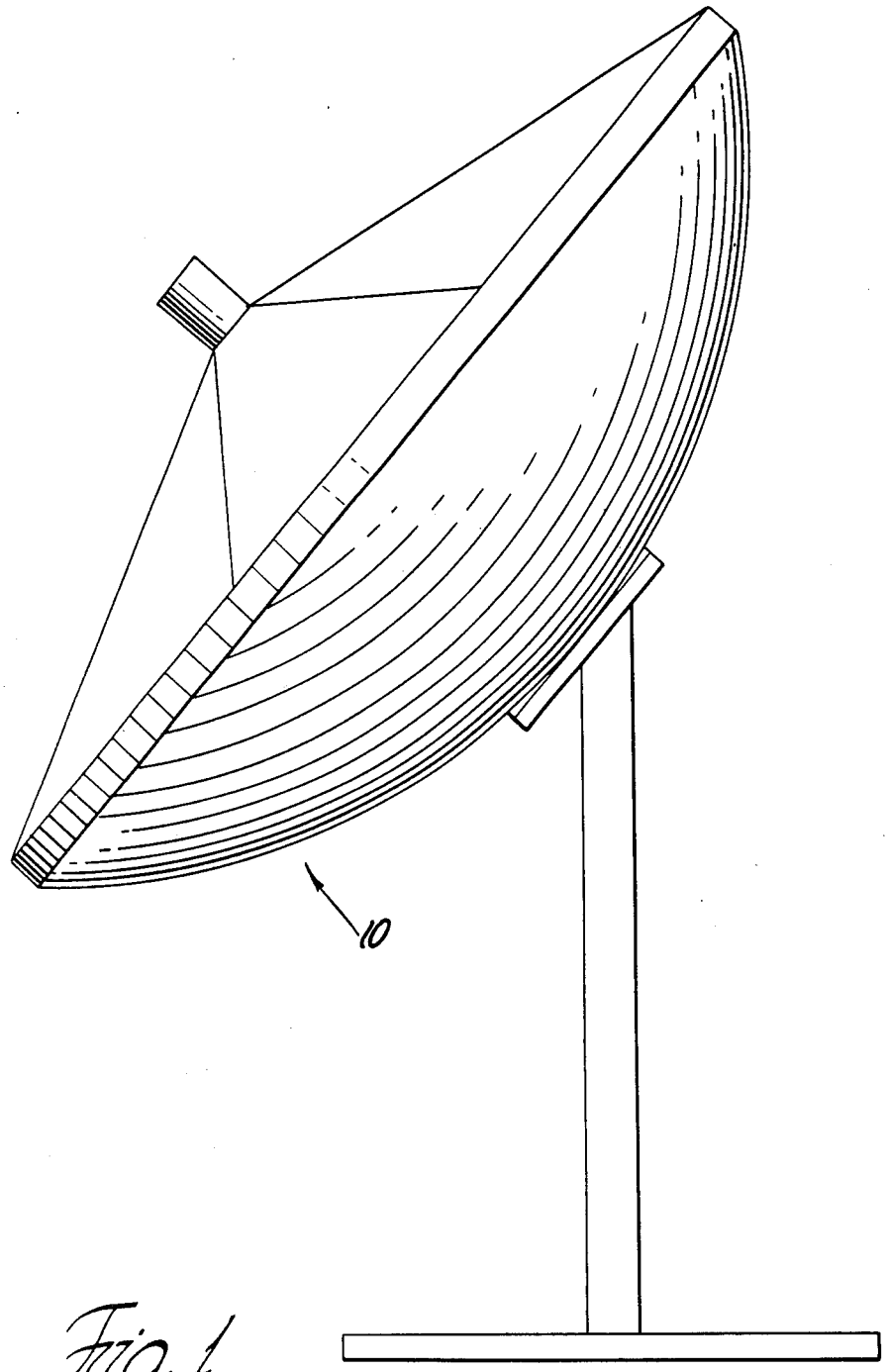
FIG. 1 is a side view of the subject invention on a support frame.
Figure 2:
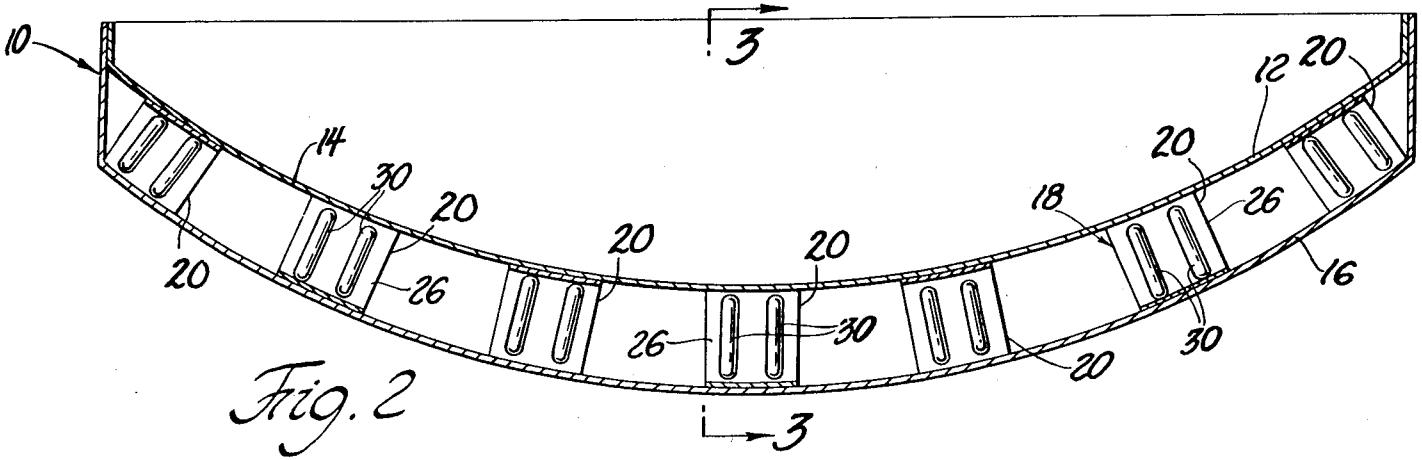
FIG. 2 is a sectional view of the subject invention.

A radio signal receiver or antenna utilizing the subject invention is generally shown at 10 in FIG. 1. With reference to FIG. 2, the antenna 10 comprises an inner panel 12 having a curved inner receiving surface 14 and an outer panel 16 in coextensive spaced relationship to the inner panel 12. In other words, the panels 12 and 16 are concave and may have a spherical, elliptical, or similar shaped curvature. The panels 12 and 16 may be multisectioned and connected together to form the inner and outer panels 12 and 16, respectively. Also, the panels 12 and 16 have the same curvature. In other words, the panels 12 and 16 may be spherically concentric, i.e., of the same radius.

The antenna 10 includes a structural means 18 interconnecting the panels 12 and 16 together in predetermned positions relative to one another. In other words, the structural means 18 is placed between the inner and outer panels 12 and 16 to support the inner panel 12 upon the outer panel 16, keeping the inner panel 12 coextensively spaced to the outer panel 16, and for interlocking the inner and outer panels 12 and 16 to the structural means 18 at various distances apart over the extent of the panels 12 and 16.

Figure 3:
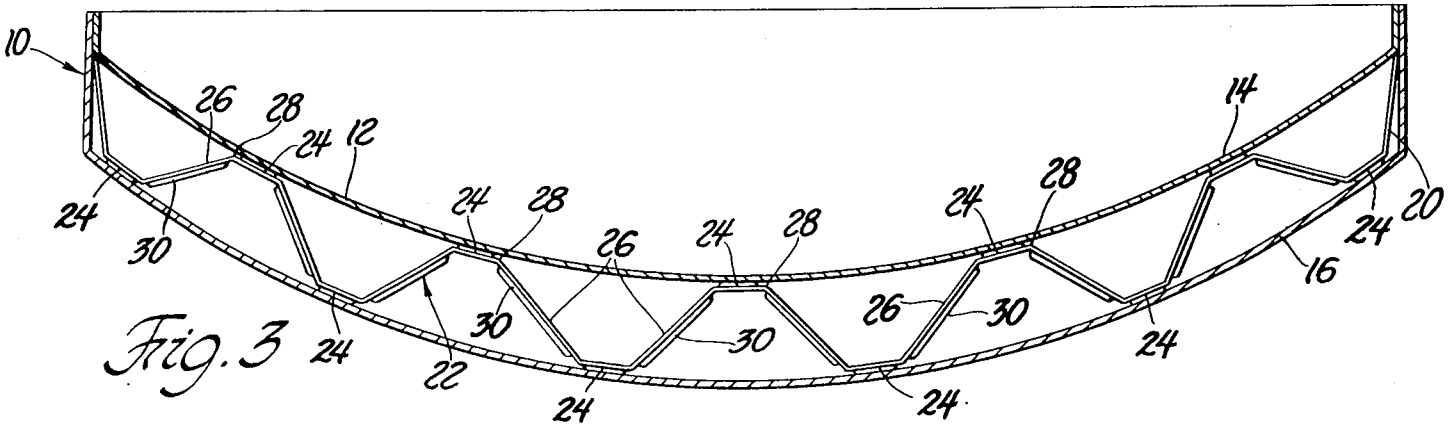
FIG. 3 is a sectional view of the subject invention along line 3—3 of FIG. 2.
Figure 4:
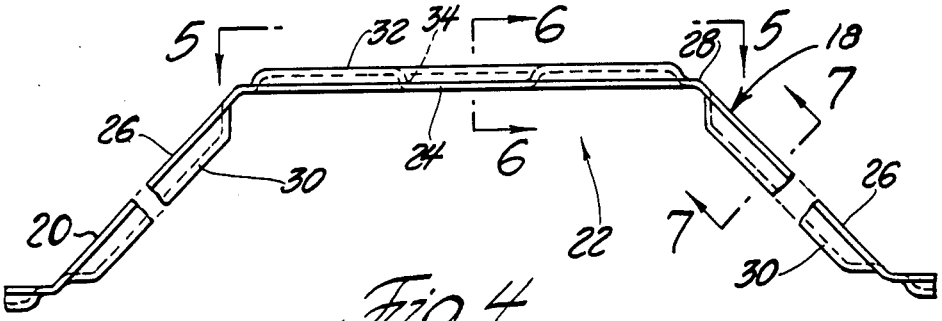
FIG. 4 is a profile view of the structural means of the subject invention.
Figure 5:
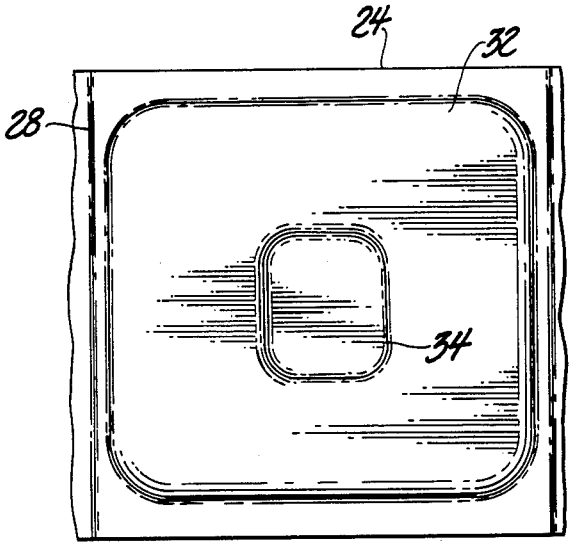
FIG. 5 is a fragmentary plan view of the subject invention of FIG. 4.
Figure 6:
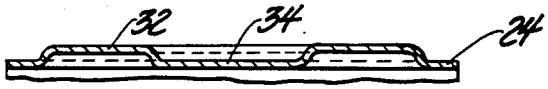
FIG. 6 is a sectional view of the subject invention along line 6—6 of FIG. 4.
Figure 7:
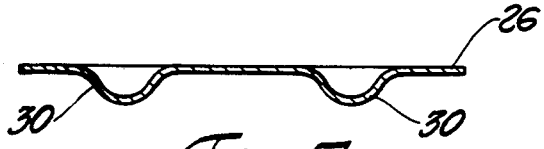
FIG. 7 is a sectional view of the subject invention along line 7—7 of FIG. 4.

With reference to FIG. 3, the structural means 18 comprises a plurality of strips 20 having undulations 22 connected to the respective panels 12, 16 to lock the panels 12, 16 together in a predetermined precise position to define a composite antenna 10 of substantial strength, and to present the inner surface 14 within predetermined close tolerances over the surface thereof. The undulations 22 of the strip 20 include platform portions 24 for engaging the panels 12 and 16, and straight angulated portions 26 interconnecting the platform portions 24. In other words, the undulations 22 are defined by oppositely facing and spaced platform portions 24 for engaging the panels 12 and 16, and straight angulated or inclined portions 26 interconnecting the platform portions 24. Since the thickness of space between the panels 12, 16 varies over the extent thereof, the undulated strips 20 present varying thicknesses between adjacent platform portions 24 to accommodate the varying thickness of the space between the panels 12, 16. These adjacent strips 20 extend generally in the same direction and are spaced apart, i.e., the strips are generally parallel. The radial thickness of the strips 20 vary between adjacent platform portions 24 because the panels 12, 16 are concentric but not parallel in spaced relationship to one another, causing the thickness of the space between the panels 12, 16 to vary over the extent thereof. Said another way, the panels 12 and 16 are associated one to the other in a manner analogous to stacked soup bowls and the strips 20 fill the space therebetween. The undulations 22 of adjacent strips 20 are offset from one another longitudinal of said strips 20 to enhance the truss-type structural integrity of the assembly. The undulations of adjacent strips 20 are offset or staggered relative to one another so that the platform portions 24 are not in line or parallel relative to one another.

Each strip 20 includes hinge portions 28 between the straight portions 26 and the platform portions 24. With reference to FIGS. 4–7, each strip 20 also includes raised ribs 30 in the straight portions 26. In other words, since the strip 20 is foldable or acts like an accordian, the hinge portions 28 between the straight portions 26 and platform portions 24 allow the lateral extent of the structural means 18 to increase while the extent between the panels 12 and 16 is decreased. Further, the straight portions 26 of the strip 20 are strengthened by raised ribs 30 so that the strip 20 flexes only at the hinge portions 28. Each of the platform portions 24 includes a raised surface 32 with a centrally disposed depression 34. In other words, the raised portion 32 contacts the panels 12 and 16.

In accordance with the subject invention, there is provided a method of fabricating a radio signal antenna 10 for receiving radio signals including an inner panel 12 with a curved inner receiving surface 14 and an outer panel 16, including the steps of positioning the inner 12 and outer 16 panels in coextensive spaced relationship to one another. This is accomplished specifically by positioning structural means 18 between the inner 12 and outer 16 panels for interlocking the panels 12 and 16 together over the extent thereof. Further, the steps include moving the inner and outer panels 12 and 16 together to diminish the thickness of the structural means 18 between the panels 12 and 16 until the panels 12 and 16 are in predetermined positions relative to one another and respectfully engaging the structural means 18, and precisely positioning the inner surface 14 of the inner panel 12 within closely predetermined tolerances. In other words, the structural means 18 moves radially with respect to the panels 12 and 16 to diminish the radial distance or height of the structural means 18 between the panels 12 and 16 until the panels 12 and 16 are in their predetermined positions. The steps further include locking the structural means 18 and the panels 12 and 16 together in the predetermined positions while maintaining the predetermined precise position of the inner surface 14 of the inner panel 12 to define a composite antenna 10 of substantial strength provided by the panels 12, 16, and the structural means 18 locked together to present the inner surface 14 within the predetermined close tolerances over the surface thereof. In other words, structural means 18 and panels 12, 16 are maintained in this predetermined position to lock or fix the panels 12 and 16 and structural means 18 together as one unit, rendering the antenna 10 and inner surface 14 immovable. More specifically, increasing the lateral extent of the structural means 18 as the thickness of the structural means 18 between the panels 12 and 16 is decreased.

Figure 8:
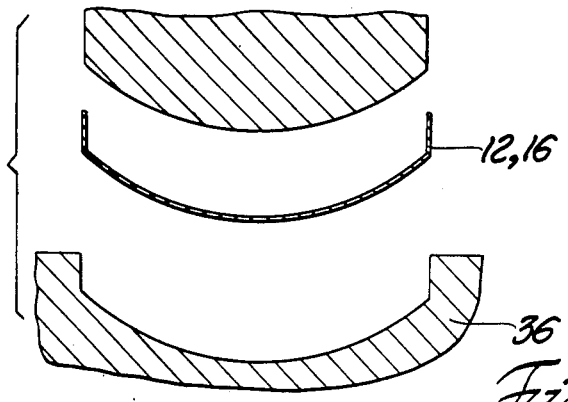
FIG. 8 is a sectional view of an apparatus for fabricating the panels of the subject invention.
Figure 9:
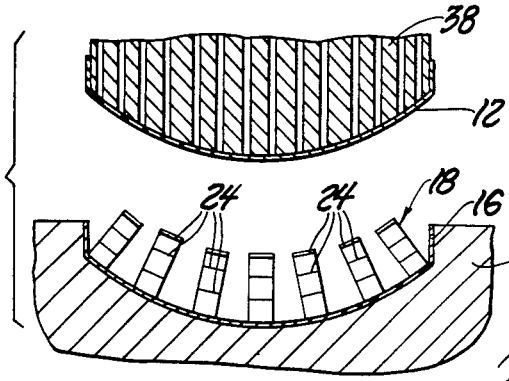
FIG. 9 is a sectional view of an apparatus for assembling the subject invention.
Figure 10:
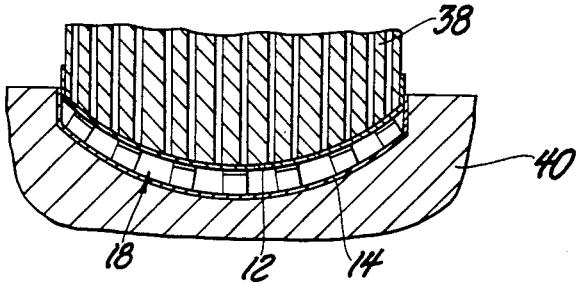
FIG. 10 is a view of an apparatus for connecting the panels together in the assembled position.

With reference to FIGS. 8 through 10, the inner and outer panels 12 and 16 are formed from the same die 36 or stamping which provides the panels 14 and 16 with the same curvature. The structural means 18 is placed between a pair of the inner and outer panels 12 and 16, respectively. The inner panel 12 is held in a predetermined position by a vacuum die 38, as illustrated in FIG. 9, while the outer panel 16 is held in a predetermined position in the die cavity or fixture 40. The structural means 18 locks the panels 12 and 16 together in the predetermined positions while maintaining these predetermined precise positions of the inner surface 14 of the inner panel 12 to lock the panels 12 and 16 and structural means 18 together, rendering the antenna 10 and inner surface 14 immovable as a single unit. With reference to FIG. 10, as the inner panel 12 moves closer to the outer panel 16, the lateral extent of the structural means 18 increases as the thickness of the structural means 18 between the panels 12 and 16 is decreased. This allows the structural means to interlock the panels 14 and 16 together at various distances apart over the expanse thereof.

The method includes locking the panels 12 and 16 and the structural means 18 together in the predetermined positions by welding the panels 12 and 16 to the structural means 18 by molten metal, adhesive bonding, or any other similar means to fix or fasten two pieces together as one unit to render the composite antenna 10 immovable. The method further includes forming the inner and outer panels 12 and 16 of the same curvature and compensating for the varying distances between the panels 12 and 16 over the lateral extent thereof when in the predetermined positions by varying the thickness of the structural means 18 over the lateral extent. In other words, since the curvature of the inner panel 12 is the same as the outer panel 16, the thickness between the panels 12, 16 over the expanse thereof will vary which, in turn, will result in a varying thickness of the structural means 18 over the lateral extent when in the predetermined positions.

The method includes forming the inner and outer panels 12 and 16 of multisections and connecting the sections together to define the inner and outer panels 12 and 16, respectively. The method further includes forming the structural means 18 in a strip 20 having undulations 22 defined by oppositely facing and spaced platform portions 24 for engaging the respective panels 12, 16 and interconnected by straight angulated portions 26. In other words, the structural means 18 is formed from a single strip 20 which is foldable and includes undulations 22, platform portions 24 for engaging the panels 12 and 16, and straight angulated portions 26 interconnecting the platform portions 24.

The method further includes forming the strip 20 with hinge portions 28 between the straight portions 26 and the platform portions 24, along with raised ribs 30 in the straight portions 26. Since the strip 20 acts like an accordion, the hinge portions 28 between the straight portions 26 and the platform portions 24 allow the lateral extent of structural means 18 to increase, while the extent between the panels 12 and 16 is decreased. Further, the straight portions 26 of the strip 20 are strengthened by forming raised ribs 30 so that the strip 20 flexes only at the hinge portions 28. Also, the raised surface 32 of the platform portion 24 is formed for bonding with the panels 12 and 16 along with a centrally disposed depression 34.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A method of fabricating a radio signal antenna (10) for receiving radio signals including an inner panel (12) having a curved inner receiving surface (14) and an outer panel (16), said method comprising the steps of positioning the inner panel (12) and outer (16) panels in coextensive spaced relationship to one another, positioning structural means (18) between the inner (12) and outer (16) panels for interlocking the panels (12, 16) together over the extent thereof, characterized by moving the inner (12) and outer (16) panels together to diminish the thickness of the structural means (18) between the panels (12, 16) until the panels (12, 16) are in predetermined positions relative to one another and respectively engaging the structural means (18) while precisely positioning the inner surface (14) of the inner panel (12) within closely predetermined tolerances, locking the structural means (18) and the panels (12, 16) together in the predetermined positions while maintaining the predetermined precise position of the inner surface (14) of the inner panel (12) to define a composite antenna (10) of substantial strength provided by the panels (12, 16) and structural means (18) locked together to present the inner surface (14) within the predetermined close tolerances over the surface thereof.

2. A method as set forth in claim 1 further characterized by forming the inner (12) and outer (16) panels of the same curvature and compensating for the varying distances between the panels (12,16) over the lateral extent thereof when in the predetermined positions by varying the thickness of the structural means (18) over the lateral extent.

3. A method as set forth in claim 2 further characterized by moving the panels (12, 16) together to increase the lateral extent of the structural means (18) as the thickness of the structural means (18) between the panels (12, 16) is decreased.

4. A method as set forth in claims 1, 2 or 3 further characterized by locking the panels (12,16) and the structural means (18) together in the predetermined positions by welding the panels (12,16) to the structural means (18) to render the composite antenna (10) immovable.

5. A method as set forth in claims 1, 2 or 3 further characterized by forming the inner and outer panels of multisections and connecting the sections together to define the inner (12) and outer (16) panels respectively.

6. A method as set forth in claims 1, 2 or 3 further characterized by forming the structural means (18) in at least one strip (20) having undulations (22) therein.

7. A method as set forth in claims 1, 2 or 3 further characterized by forming the structural means (18) in at least one strip (20) having undulations (22) defined by oppositely facing and spaced platform portions (24) for engaging the respective panels (12,16) and interconnected by straight angulated portions (26).

8. A method as set forth in claims 1, 2 or 3 further characterized by forming the structural means (18) in at least one strip (20) having undulations (22) defined by oppositely facing and spaced platform portions (24) for engaging the respective panels (12,16) and interconnected by straight angulated portions (26), forming raised ribs (30) in the straight portions (26) of the strip (20) to define hinge portions (28) between the straight portions (26) and the platform portions (24).

9. A method as set forth in claims 1, 2 or 3 further characterized by forming the structural means (18) in at least one strip (20) having undulations (22) defined by oppositely facing and spaced platform portions (24) for engaging the respective panels (12,16) and interconnected by straight angulated portions (26), forming raised ribs (30) in the straight portions (26) of the strip (20) to define hinge portions (28) between the straight portions (26) and the platform portions (24), and forming raised surfaces (32) in the platform portions with central depressions (34) therein.

* * * * *